US009765274B2

(12) United States Patent
Blanazs

(10) Patent No.: US 9,765,274 B2
(45) Date of Patent: Sep. 19, 2017

(54) LUBRICANT COMPOSITION INCLUDING 4-HYDROXYBENZAMIDE FRICTION MODIFIER

(71) Applicant: The Lubrizol Corporation, Wickliffe, OH (US)

(72) Inventor: Lisa Blanazs, Mannheim (DE)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 14/652,970

(22) PCT Filed: Dec. 11, 2013

(86) PCT No.: PCT/US2013/074349
§ 371 (c)(1),
(2) Date: Jun. 17, 2015

(87) PCT Pub. No.: WO2014/099537
PCT Pub. Date: Jun. 26, 2014

(65) Prior Publication Data

US 2016/0024413 A1 Jan. 28, 2016

Related U.S. Application Data

(60) Provisional application No. 61/739,760, filed on Dec. 20, 2012.

(51) Int. Cl.
*C10M 133/16* (2006.01)

(52) U.S. Cl.
CPC .. *C10M 133/16* (2013.01); *C10M 2203/1025* (2013.01); *C10M 2205/022* (2013.01); *C10M 2205/024* (2013.01); *C10M 2205/0285* (2013.01); *C10M 2207/026* (2013.01); *C10M 2207/289* (2013.01); *C10M 2215/064* (2013.01); *C10M 2215/082* (2013.01); *C10M 2219/022* (2013.01); *C10N 2220/022* (2013.01); *C10N 2230/06* (2013.01); *C10N 2230/42* (2013.01); *C10N 2230/43* (2013.01); *C10N 2230/45* (2013.01); *C10N 2240/10* (2013.01); *C10N 2280/00* (2013.01)

(58) Field of Classification Search
CPC ..... C10M 133/16; C10M 2215/082; C10M 2203/1025; C10M 2205/0285; C10M 2207/026; C10M 2207/289; C10M 2205/022; C10M 2205/024; C10M 2215/064; C10N 2230/45; C10N 2230/42; C10N 2230/43; C10N 2230/06; C10N 2220/022; C10N 2280/00; C10N 2240/10
See application file for complete search history.

(56) References Cited

U.S. PATENT DOCUMENTS

| | | | | |
|---|---|---|---|---|
| 2,959,550 | A * | 11/1960 | Young | A23L 3/3526 252/403 |
| 3,413,224 | A | 11/1968 | Knapp et al. | |
| 3,749,702 | A | 7/1973 | Boehringer et al. | |
| 3,972,927 | A | 8/1976 | Susi et al. | |
| 4,090,971 | A | 5/1978 | Hoke et al. | |
| 2005/0221999 | A1 * | 10/2005 | Nakatani | C10M 119/22 508/480 |
| 2008/0167206 | A1 | 7/2008 | Konishi et al. | |
| 2011/0028361 | A1 | 2/2011 | Konishi et al. | |
| 2011/0190180 | A1 | 8/2011 | Mosier et al. | |

* cited by examiner

*Primary Examiner* — Taiwo Oladapo
(74) *Attorney, Agent, or Firm* — Michael A. Miller; Deron A. Cook

(57) ABSTRACT

A lubricant composition includes an oil of lubricating viscosity and a 4-hydroxybenzamide as a friction modifier. The lubricant composition has a kinematic viscosity at 100° C. of from 5 to 18 mm2/s.

15 Claims, No Drawings

LUBRICANT COMPOSITION INCLUDING 4-HYDROXYBENZAMIDE FRICTION MODIFIER

FIELD OF INVENTION

The exemplary embodiment relates to a lubricant composition comprising an oil of lubricating viscosity and a 4-hydroxybenzamide as a friction modifier and anti-wear additive. The lubricant composition finds particular application for lubricating both steel and diamond-like carbon (DLC) coated components. The lubricant composition is especially suitable for use in engine oils. Also disclosed are a method of forming and a use of the lubricant composition.

BACKGROUND

It is well known for lubricant compositions to contain, in addition to a base oil, a number of additives (including friction modifiers, antiwear agents, antioxidants, dispersants, and detergents) that are used to protect internal combustion engines from wear, oxidation, soot deposits, acid build up, and the like. A friction modifier can be any material that can alter the coefficient of friction of the lubricant composition that contains it. Friction modifiers, also known as friction reducers, that change the coefficient of friction of lubricant base oils and fully formulated lubricant compositions, conventionally may include metal-containing compounds as well as ashless compounds or materials, or mixtures thereof. Metal-containing friction modifiers include metal salts or metal-ligand complexes where the metals may include alkali, alkaline earth, or transition group metals. Transition metals include Mo, Sb, Sn, Fe, Cu, Zn, Ti, and others. For example, molybdenum dithiocarbamates dithiophosphates, amines, alcohol-amides, and the like have been used. Ashless friction modifiers include lubricant materials that contain effective amounts of polar groups, for example hydroxyl-containing hydrocarbyl base oils, glycerides, partial glycerides, glyceride derivatives, and the like. Other friction modifiers include salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Engine lubricant compositions containing phosphorus compounds and sulfur have been shown to contribute to particulate emissions and emissions of other pollutants. In addition, sulfur and phosphorus tend to poison the catalysts used in catalytic converters, resulting in a reduction in performance of such catalysts.

It would be desirable to provide a lubricant composition which provides low-friction sliding between components to improve abrasion resistance in an automotive engine and vehicle fuel efficiency without compromising durability (i.e. the ability to resist wear).

REFERENCES

U.S. Pat. No. 2,959,550, issued Nov. 8, 1960, entitled "Nonvolatile Organic Compositions Stabilized by N-Alkyl p-Hydroxybenzamide," by Young, et al., discloses p-hydroxybenzamides, derived from amines having 4 to 24 carbon atoms, as antioxidants for non-volatile compositions, including rubber, plastics, and greases.

U.S. Pat. No. 3,413,224 issued Nov. 16, 1968, entitled "Antioxidants," by Knapp, discloses dialkyl-p-hydroxy (thio)benzamides as antioxidants for organic materials, especially greases, waxes, and lubricating oil compositions.

U.S. Pat. No. 3,749,702, issued Jul. 31, 1973, entitled "Lubricant Additive," by Boehringer, et al., discloses aminoguanidine amides of substituted benzoic acid, e.g. hydroxyl-benzoic acid, that are salted with bicarbonate to produce lubricant additives especially useful as metal deactivators.

U.S. Pat. No. 4,090,971, issued May 23, 1978, entitled "Substituted Salicylamides and Lubricants Containing the Same," by Hoke, discloses amides of alkyl-substituted hydroxyaromatic carboxylic acids, especially alkyl-substituted salicylic acids, which are useful as dispersant additives for lubricants and fuels.

U.S. Pub. No. 20110028361, published Feb. 3, 2011, entitled "Low-Friction Sliding Mechanism," by Konishi, et al., discloses a lubricant applied to sliding surfaces, one or both of which is formed from diamond-like carbon material. The lubricant contains a base oil and at least one of an ashless fatty-ester friction modifier and an ashless aliphatic-amine friction modifier.

U.S. Pub. No. 20110190180, published Aug. 4, 2011, entitled "Composition Containing Heterocyclic Compounds and a Method of Lubricating an Internal Combustion Engine," by Mosier, et al., discloses lubricating composition which includes a compound useful an engine oil antiwear or extreme pressure agent, that is a heterocycle having a hydrocarbyl group containing 6 to 40 carbon atoms, the heterocycle having a functional group selected from esters, amides, salts and acids, or a being a heterocycle that is a pyrimidine.

BRIEF DESCRIPTION

In one aspect of the exemplary embodiment, a lubricant composition includes an oil of lubricating viscosity and a 4-hydroxybenzamide as a friction modifier. The lubricant composition may have a kinematic viscosity at 100° C. of from 5 to 18 $mm^2/s$.

In another aspect of the exemplary embodiment, a method of friction reduction in an internal combustion engine may include contacting a contact surface of the internal combustion engine with the lubricant composition.

In one embodiment, there is provided a method reducing friction, reducing wear, or reducing both friction and wear in an internal combustion engine.

In another aspect of the exemplary embodiment, a process for preparing a lubricant composition includes blending an oil of lubricating viscosity, an 4-hydroxybenzamide, and optionally one or more other performance additives to form a lubricant composition having a kinematic viscosity at 100° C. of from 5 to 18 $mm^2/s$.

In another aspect of the exemplary embodiment, an internal combustion engine includes first and second sliding members in sliding contact. Each sliding member defines a respective sliding surface, at least one of which slides relative to the other sliding surface. At least one of the sliding surfaces is formed from steel, steel alloy, or a diamond-like carbon (DLC) material. The lubricant composition is interposed between the sliding surfaces to lubricate them during sliding.

DETAILED DESCRIPTION

An exemplary lubricant composition includes an oil of lubricating viscosity and a friction modifier. The exemplary lubricant composition finds use as an engine oil in an internal combustion engine, such as a motor vehicle engine. In one embodiment, the lubricant composition is used as a crankcase lubricant. A crankcase lubricant is an oil used for general lubrication in an internal combustion engine where an oil sump is situated generally below the crankshaft of the engine and to which circulated oil returns.

As the friction modifier, a 4-hydroxybenzamide is employed. The 4-hydroxybenzamide may have the general formula:

(I)

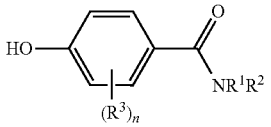

where $R^1$ and $R^2$ are independently selected from hydrogen and a hydrocarbyl group; each hydrocarbyl group may contain from 1 to 32 carbon atoms, such as at least 6, or at least 8 carbon atoms, or at least 12 carbon atoms, and may contain up to 22, or up to 20, or up to 18 carbon atoms;

at least one of $R^1$ and $R^2$ is a hydrocarbyl group or the $R^1$ and $R^2$ groups together form a ring;

each $R^3$ may be independently hydrocarbyl groups of 1 to 8 carbon atoms; and n is an integer, e.g., from 0 to 3.

In one embodiment, at least one of $R^1$ and $R^2$ is a hydrocarbyl group containing from 6 to 32 carbon atoms. For example, at least one of $R^1$ and $R^2$ is a hydrocarbyl group containing from 8 to 22 or from 16 to 20 carbon atoms.

In one embodiment, $R^1$ is H.

$R^3$ may be selected to influence solubility in the selected oil of lubricating viscosity. In one embodiment, n is at least 1 and $R^3$ is a hydrocarbyl group; the hydrocarbyl group containing from 1 to 8 carbon atoms.

In another embodiment, n is 0.

In one embodiment, the 4-hydroxybenzamide includes at least one of an alkyl-4-hydroxybenzamide and an alkenyl-4-hydroxybenzamide, i.e., at least one of $R^1$ and $R^2$ is an alkyl or alkenyl group. In the case of an alkenyl-4-hydroxybenzamide, it may be mono-, di-, tri- or more unsaturated.

In one embodiment, the alkyl/alkenyl-4-hydroxybenzamide is or includes N-oleyl-4-hydroxybenzamide according to Formula (II):

(II)

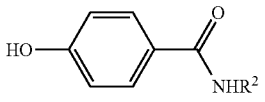

where $R^2$ is any isomer of octadecene, such as 9-octadecene.

In one embodiment, the alkyl/alkenyl-4-hydroxybenzamide is a derivative of N-oleyl-4-hydroxybenzamide, as shown in Formula (II) except for that at least one $R^3$ is present, as in Formula (I).

In the case of the $R^1$ and $R^2$ groups together forming a ring, the ring includes the nitrogen atom and substituents (if any) of the carbon atoms in the ring are limited to alkyl and alkenyl hydrocarbyl groups, excluding cycloalkyl and cycloalkenyl groups. For example, the ring form of the 4-hydroxybenzamide may have the general formula shown in Formula (III):

(III)

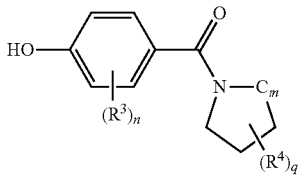

where each $R^3$ and n are as for formula (I), m is an integer from 1 to 2;

each $R^4$ is independently a hydrocarbyl group of 1 to 32 carbon atoms;

q is an integer from 0 to 5.

Suitable hydrocarbyl groups useful as $R^1$, $R^2$, $R^3$, and $R^4$ include linear, branched, cyclic, acyclic, saturated, unsaturated, aliphatic, aromatic, hydrocarbyl groups, or any combination thereof. In certain embodiments they are selected from linear and branched alkyl and alkenyl groups, and, in particular, from linear alkyl and linear alkenyl groups. Examples of alkyl groups suitable as $R^1$ and $R^2$ include hexyl, heptyl, octyl, nonyl, decyl, undecyl, dodecyl, tridecyl, tetradecyl, pentadecyl, hexadecyl, heptadecyl, octadecyl, nonadecyl, icosyl, heneicosyl, docosyl, tricosyl, tetracosyl, pentacosyl, hexacosyl, heptacosyl, octacosyl, nonacosyl and triacontyl. Examples of alkenyl groups suitable as $R^1$ and $R^2$ include hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, heneicosenyl, docosenyl, tricosenyl, tetracosenyl, pentacosenyl, hexacosenyl, heptacosenyl, octacosenyl, nonacosenyl and triacontenyl. The above alkyl and alkenyl groups include all possible isomers. Alkyl and alkenyl groups suitable as $R^3$ and $R^4$ include those listed for $R^1$ and $R^2$ and also shorter chain alkyl and alkenyl groups including methyl, ethyl, propyl, butyl, pentyl, and ethenyl, propenyl, butenyl, and pentenyl.

In some embodiments, $R^1$ and $R^2$ are selected from H and linear and branched alkyl and alkenyl groups containing from 8 to 32 carbon atoms and including at least a $C_8$ chain.

The content of the 4-hydroxybenzamide according to formula (I) in lubricant composition may be up to 5 wt. %, or up to 4 wt. %, or up to 3 wt. %, or up to 2 wt. %, or up to 1 wt. %. The 4-hydroxybenzamide may be present in the lubricant composition at a concentration of at least at least 0.05 wt. %, or at least 0.1 wt. %, or at least 0.2 wt. %, or at least 0.3 wt. %, or at least 0.4 wt. %.

The oil of lubricating viscosity may be present in the lubricant composition at a total concentration of at least 40 wt. %, or at least 50 wt. %, or at least 60 wt. %.

As used herein kinematic viscosity is measured at 100° C. (KV_100), according to the method of ASTM D445-12, "Standard Test Method for Kinematic Viscosity of Transparent and Opaque Liquids (and Calculation of Dynamic Viscosity)", ASTM International, West Conshohocken, Pa., DOI: 10.1520/D0445-12. This test method specifies a procedure for the determination of the kinematic viscosity, of liquid petroleum products by measuring the time for a volume of liquid to flow under gravity through a calibrated glass capillary viscometer. It may be noted that 1 $mm^2/s=10^{-6}$ $m^2/s=1$ cSt. The lubricant composition may have a kinematic viscosity at 100° C. (KV_100), prior to use as a lubricant, of from 5 to 18 $mm^2/s$. The lubricant composition may have a (KV_100) of at least 6 $mm^2/s$, or at least 7 $mm^2/s$. In some embodiments, the lubricant composition may have a KV_100 of up to 12 $mm^2/s$, or up to 10 $mm^2/s$.

The oil of lubricating viscosity employed in the lubricant composition may have a KV_100 of at least 3 $mm^2/s$, or at least 5 $mm^2/s$, and may have a kinematic viscosity at 100° C. of up to 10 $mm^2/s$, or up to 8 $mm^2/s$.

The lubricant composition, prior to use, may have a sulfated ash content of up to 1.3 wt. %, or up to 1.0 wt. %, or up to 0.8 wt. %, a sulfur content of up to 0.4 wt. %, or up to 0.3 wt. %, and a phosphorus content of up to 0.12 wt. %, or up to 0.08 wt. %. Such a lubricant composition is referred to a low SAPS composition (low sulfated ash, phosphorus, and sulfur). The low SAPS composition helps to reduce wear on the lubricated components, as well as keeping the amount of harmful emissions low so as to extend the life of the catalyst in the catalytic converter. However, compositions with higher amounts of one or more of these components are also contemplated.

As used herein, sulfated ash content is measured according to the method of ASTM D-874-07, "Standard Test Method for Sulfated Ash from Lubricating Oils and Additives," ASTM International, West Conshohocken, Pa., DOI: 10.1520/D0874-07. This test method covers the determination of the sulfated ash from unused lubricating oils containing additives and from additive concentrates used in compounding. The lower limit of the test method is 0.005 wt. % sulfated ash. The exemplary lubricant composition may have a sulfated ash content below the lower limit, or at least 0.1 wt. %. In one embodiment, the lubricant composition may have at least 0.1 wt. sulphated ash or at least 0.25 wt. % sulfated ash.

Elemental analysis for sulfur and phosphorus may be performed by Inductively Coupled Plasma Atomic Emission Spectroscopy (ICP-AES). Sulfur and phosphorus contents reported herein are measured by ASTM D5185-09, "Standard Test Method for Determination of Additive Elements, Wear Metals, and Contaminants in Used Lubricating Oils and Determination of Selected Elements in Base Oils by Inductively Coupled Plasma Atomic Emission Spectrometry (ICP-AES)," DOI: 10.1520/D5185-09.

The exemplary lubricant composition may have a sulfur content of at least 0.01 wt. %, or at least 0.1 wt. %. The exemplary lubricant composition may have a phosphorus content of at least 0.001 wt. %, or at least 0.01 wt. %.

In addition to the oil of lubricating viscosity and the 4-hydroxybenzamide friction modifier, the lubricant composition may include one or more performance additives.

In another embodiment, a lubricant concentrate is provided. The lubricant concentrate contains a higher weight ratio of the 4-hydroxybenzamide to the oil of lubricating viscosity and may include one or more performance additives. Such a lubricant concentrate is suited to forming the lubricant composition by addition of an oil of lubricating viscosity and optionally one or more performance additives.

Oil of Lubricating Viscosity

Suitable oils of lubricating viscosity include natural and synthetic oils, oils derived from hydrocracking, hydrogenation, and hydrofinishing, unrefined, refined and re-refined oils, and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in as oils of lubricating viscosity include animal oils or vegetable oils (e.g., castor oil or lard oil), mineral lubricating oils, such as liquid petroleum oils and solvent-treated or acid-treated mineral lubricating oils of the paraffinic, naphthenic or mixed paraffinic-naphthenic types, and oils derived from coal or shale or mixtures thereof.

Synthetic lubricating oils useful as oils of lubricating viscosity include hydrocarbon oils, such as polymerized and copolymerized olefins (e.g., polybutylenes, polypropylenes, propyleneisobutylene copolymers); poly(1-hexenes), poly (1-octenes), poly(1-decenes), and mixtures thereof; alkylbenzenes (e.g., dodecylbenzenes, tetradecylbenzenes, dinonylbenzenes, di-(2-ethylhexyl)-benzenes); polyphenyls (e.g., biphenyls, terphenyls, alkylated polyphenyls); alkylated diphenyl ethers and alkylated diphenyl sulfides and the derivatives, analogs and homologs thereof, and mixtures thereof.

Other synthetic lubricating oils include polyol esters (such as Priolube®3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid (GTL) oils.

Oils of lubricating viscosity may also be defined as specified in the American Petroleum Institute (API) Base Oil Interchangeability Guidelines. The five base oil groups are as follows: Group I (sulfur content >0.03 wt. %, and/or <90 wt. % saturates, viscosity index 80-120); Group II (sulfur content ≤0.03 wt. %, and ≥90 wt. % saturates, viscosity index 80-120); Group III (sulfur content ≤0.03 wt. %, and ≥90 wt. % saturates, viscosity index ≥120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixtures thereof.

In some embodiments, at least 5 wt. %, or at least 10 wt. %, or at least 20 wt. %, or at least 40 wt. % of the lubricant composition is a polyalphaolefin (Group IV).

Performance Additives

In one embodiment, the lubricant composition or lubricant concentrate includes at least one performance additive (other than the 4-hydroxybenzamide friction modifier discussed above, which for convenience of the present description and claims, is not considered a "performance additive"). The performance additive(s) can include at least one of metal deactivators, detergents, dispersants, extreme pressure agents, antiwear agents, antioxidants, corrosion inhibitors, foam inhibitors, demulsifiers, pour point depressants, viscosity modifiers, other friction modifiers, seal swelling agents and mixtures thereof. In one embodiment, the performance additives may be used alone or in combination.

The total combined amount of the performance additives present may range from 0 wt. % to 30 wt. %, or from 1 wt. % to 25 wt. %, or from 2 wt. % to 20 wt. %, or from 3 wt. % to 10 wt. % of the lubricant composition. Although one or more of the performance additives may be present, it is common for the performance additives to be present in different amounts relative to each other.

In the case of a lubricant concentrate (which may be combined with additional oil to form, in whole or in part, a finished lubricant composition), the ratio of the various performance additives to the oil of lubricating viscosity and/or to diluent oil include the ranges of 80:20 to 10:90 by weight.

Exemplary friction modifiers include fatty amines, esters such as glycerol esters, fatty phosphites, fatty acid amides, fatty epoxides, borated fatty epoxides, alkoxylated fatty amines, borated alkoxylated fatty amines, esters and amides of α-hydroxycarboxylic acid compounds, metal salts of fatty acids, fatty imidazolines, condensation products of carboxylic acids and polyalkylene-polyamines, amine salts of alkylphosphoric acids, molybdenum dithiocarbamate or mixtures thereof.

Exemplary antioxidants useful as oxidation inhibitors include sulfurized olefins, hindered phenols, diarylamines (such as diphenylamines, e.g., alkylated diphenylamines), phenyl-alpha-naphthylamines, hindered phenol esters, molybdenum dithiocarbamates, and mixtures and derivatives thereof. Antioxidant compounds may be used alone or in combination.

In one embodiment, the lubricant composition is free of zinc dithiophosphate (ZDP), a commonly-used antioxidant. By "free," it is meant that the lubricant composition contains less than 0.01 wt. % or less than 0.001 weight %, or in fact 0 weight % of ZDP.

Exemplary detergents include neutral or overbased, Newtonian or non-Newtonian, basic salts of alkali, alkaline earth and transition metals with one or more of a phenate, a sulfurized phenate, a sulfonate, a carboxylic acid, a phosphorus acid, a mono- and/or a di-thiophosphoric acid, a saligenin, an alkylsalicylate, a salixarate or mixtures thereof. A neutral detergent has a metal:detergent (soap) molar ratio of approximately one. An overbased detergent has a metal: detergent molar ratio exceeding one, i.e. the metal content is more than that necessary to provide for a neutral salt of the detergent. In one embodiment the lubricant composition comprises at least one overbased metal-containing detergent with a metal:detergent molar ratio of at least 3. The overbased detergent may have a metal:detergent molar ratio of at least 5, or at least 8, or at least 12.

In one embodiment, the alkali or alkaline earth metal overbased detergent comprises a calcium, sodium, or magnesium detergent, or combination thereof. In one embodiment, the metal detergent comprises a calcium detergent.

Exemplary dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include succinimides, phosphonates, and combinations thereof.

Exemplary succinimide dispersants can include N-substituted long chain alkenyl succinimides as well as post-treated versions thereof. U.S. Pat. Nos. 3,215,707; 3,231,587; 3,515,669; 3,579,450; 3,912,764; 4,605,808; 4,152,499; 5,071,919; 5,137,980; 5,286,823; 5,254,649 describe methods for forming such dispersants and their components. Post-treated dispersants include those further treated by reaction with materials such as urea, boron, thiourea, dimercaptothiadiazoles, carbon disulfide, aldehydes, ketones, carboxylic acids, hydrocarbon-substituted succinic anhydrides, nitriles, epoxides and phosphorus compounds.

For example such dispersants can be produced by reaction of a C3-C6 polyalkylene (e.g., polypropylene, polyisobutylene, polypentylene, polyheptylene) or derivative thereof (e.g., a chlorinated derivative) with a mono- or α/β unsaturated-dicarboxylic acid or anhydride thereof (such as maleic anhydride or succinic anhydride) to produce an acylated C3-C6 polyalkylene compound, which is reacted with an amine, such as a primary amine or a polyamine, such as a polyethylene amine, to produce the dispersant.

Polyisobutylene (PIB) is known to exist in multiple aspects. Terminal vinylidene, also referred to as methyl vinylidene, moieties will react readily with acylating agents in the absence of a free radical initiator or halogen promoter. PIB with greater than 50% methylvinylidene content may be identified as high vinylidene. In one embodiment, the lubricating composition may include a dispersant derived from a high vinylidene polyisobutylene.

Other exemplary dispersants can be derived from polyisobutylene, an amine and zinc oxide to form a polyisobutylene succinimide complex with zinc.

In one embodiment, the ashless dispersant is boron-containing, i.e. has incorporated boron and delivers the boron to the lubricant composition. The boron-containing dispersant may be present in an amount that is sufficient to deliver at least 25 ppm boron, at least 50 ppm boron, or at least 100 ppm boron to the lubricant composition. In one embodiment, the lubricant composition is free of a boron-containing dispersant, i.e. delivers no more than 10 ppm boron or even less than 1 ppm boron to the final formulation.

Another class of ashless dispersant is acylated polyalkylene polyamines of the type described in U.S. Pat. No. 5,330,667.

Another class of ashless dispersants is Mannich bases. Mannich dispersants are the reaction products of alkyl phenols with aldehydes (especially formaldehyde) and amines (especially polyalkylene polyamines). The alkyl group typically contains at least 30 carbon atoms.

Antiwear agents can include compounds such as metal thiophosphates, especially zinc dialkyldithiophosphates (ZDDP); phosphoric acid esters or salt thereof; phosphites; and phosphorus-containing carboxylic esters, ethers, and amides; antiscuffing agents including organic sulfides and polysulfides, such as benzyldisulfide, bis-(chlorobenzyl)disulfide, dibutyl tetrasulfide, di-tertiary butyl polysulfide, di-tert-butylsulfide, sulfurized Diels-Alder adducts, or alkyl sulphenyl N'N-dialkyl dithiocarbamates.

Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; sulfurized olefins (such as sulfurized isobutylene), organic sulfides and polysulfides such as dibenzyldisulfide, bis-(chlorobenzyl) disulfide, dibutyl tetrasulfide, sulfurized methyl ester of oleic acid, sulfurized alkylphenol, dimercaptothiadiazoles, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof (as described, for example, in U.S. Pat. No. 3,197,405).

Exemplary corrosion inhibitors can include octylamine octanoate, condensation products of dodecenyl succinic acid or anhydride and a fatty acid such as oleic acid with a polyamine; metal deactivators including derivatives of benzotriazoles, thiadiazoles such as dimercaptothiadiazole and its derivatives, 1,2,4-triazoles, benzimidazoles, 2-alkyldithiobenzimidazoles, and 2-alkyldithiobenzothiazoles.

Suitable foam inhibitors include silicones, copolymers of ethyl acrylate and 2-ethylhexylacrylate which optionally further include vinyl acetate; and demulsifiers including polyethylene glycols, polyethylene oxides, polypropylene oxides and (ethylene oxide-propylene oxide) polymers.

Pour point depressants, including esters of maleic anhydride-styrene, polymethacrylates, polyacrylates or polyacrylamides; and seal swell agents including Exxon Necton-37™ (FN 1380) and Exxon Mineral Seal Oil (FN 3200); may also be used in the exemplary lubricant composition or lubricant concentrate.

In one embodiment, the exemplary lubricant composition or lubricant concentrate is free of sulfurized olefins and amine phosphates. By "free," it is meant that these ingredients, individually or in combination, amount to less than 0.01%, less than 0.001%, or even 0% of the lubricant composition.

Synthesis of the Lubricant Composition

In another aspect of the exemplary embodiment, a process for preparing a lubricant composition includes blending an oil of lubricating viscosity, a 4-hydroxybenzamide, and optionally one or more other performance additives to form a lubricant composition having a kinematic viscosity at 100° C. of from 5 to 18 $mm^2/s$.

Such a lubricating viscosity is achieved through the selection of appropriate base oils in combination with the additives (which may contribute to overall viscosity) and polymeric viscosity index improvers, which are designed to increase the viscosity of the lubricant under operating temperatures as well as increase the viscosity index of the composition.

The 4-hydroxybenzamide may be obtained by result of reacting a 4-hydroxybenzoic acid, or reactive equivalent, with an alkyl/alkenyl amine at a sufficient temperature and for sufficient time to form the 4-hydroxybenzamide. Reactive equivalents include benzoic acid, hydrocarbyl ester of said acid, acid anhydride, acid halide, and mixtures thereof. In one embodiment, the amine is reacted with a hydrocarbyl ester of 4-hydroxybenzoic acid, i.e. 4-hydroxybenzoate. The alkyl/alkenyl amine may be saturated or unsaturated, branched or unbranched (i.e. linear). Examples include primary alkyl amines of from 1-32 carbon atoms, or at least 6, or at least 8, or at least 12, or up to 24 carbon atoms. Examples include amines of saturated fatty acids, such as hexanoic, heptanoic, octanoic, nonanoic, decanoic, undecanoic, tridecanoic, tetradecanoic, pentadecanoic, hexadecanoic, heptadecanoic, octadecanoic, nonadecanoic, eicosanoic, heneicosanoic, deocosanoic, tricosanoic, tetracosanoic, pentacosanoic, hexacosanoic, heptacosanoic, octacosanoic, and nonacosanoic acids, amines of unsaturated fatty acids, having at least one double bond, such as myristoleic, palmitoleic, sapienic, oleic, elaidic, vaccenic, linoleic, linoelaidic, α-linolenic, arachidonic, eicosapentaenoic, erucic, and docosahexaenoic acids, combinations thereof, and the like. An example amine is oleylamine (1-amino-9-octadecene). As will be appreciated, amines formed from naturally occurring fatty acids may include mixtures of amines having a range of chain lengths.

As will be appreciated, the alkyl-4-hydroxybenzoate is optionally substituted with $R^3$ groups as described above. The alkyl-4-hydroxybenzoate can be a $R^5$-4-hydroxybenzoate, where $R^5$ represents a $C_1$-$C_{20}$ alkyl group, or $C_1$-$C_4$ alkyl group. Examples include methyl-4-hydroxybenzoate, ethyl-4-hydroxybenzoate, propyl-4-hydroxybenzoate, butyl-4-hydroxybenzoate, $R^3$-substituted derivatives thereof, and mixtures thereof.

As an example, oleyl-4-hydroxybenzamide may be formed according to reaction scheme 1, by reacting approximately equimolar amounts of methyl-4-hydroxybenzoate and oleylamine at a temperature of from about 80-180° C. until the reaction is substantially complete, e.g., from 20-100 hrs. Suitably, the temperature is progressively increased as the reaction proceeds.

Reaction Scheme 1

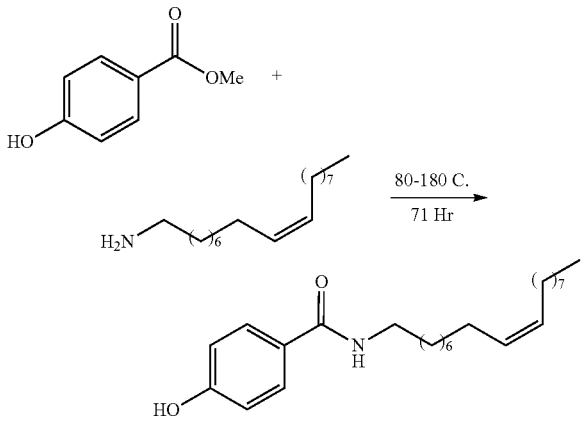

The reaction can be carried out in the presence of a solvent. The solvent can be a liquid organic diluent. Generally, the solvent has as a boiling point that is high enough to provide the required reaction temperature. Illustrative diluents include toluene, t-butyl benzene, benzene, xylene, chlorobenzene, various petroleum fractions boiling above 125° C., and mixtures thereof.

In general the reaction proceeds without the need for an initiator.

The completion of the reaction may be assessed by determining the total acid number (TAN) and/or total base number (TBN). TAN may be determined by titration with 0.1M KOH phenolphthalein indicator in toluene/isopropanol/water (500:495:5 parts), measured in mg KOH/g. TBN can be measured by 0.1M perchloric acid titration with potentiometric end point determination in chlorobenzene.

To form the lubricant composition, the 4-hydroxybenzamide may be blended with a suitable oil of lubricating viscosity, such as one having a KV_100 of at least 3 $mm^2/s$, or at least 5 $mm^2/s$, or up to 10 $mm^2/s$, or up to 8 $mm^2/S$, and one or more performance additives as described above, to form the lubricant composition.

INDUSTRIAL APPLICATION

In one aspect of the exemplary embodiment, a method of friction reduction in an internal combustion engine may include contacting a contact surface of the internal combustion engine with the exemplary lubricant composition. The contact surface may include at least one of a steel surface and a steel alloy surface. The lubricant composition may be interposed between the contact surface and a second surface which, during operation of the internal combustion engine, moves relative to the contact surface.

In another aspect, the lubricant composition is used in an internal combustion engine which includes first and second sliding members in sliding contact, each sliding member defining a respective sliding surface, at least one of which slides relative to the other sliding surface. At least one of the sliding surfaces is formed from steel (or alloy of steel) or a diamond-like carbon (DLC) material, or combination thereof. A lubricant composition is interposed between the sliding surfaces to lubricate them during sliding. The lubricant composition includes an oil of lubricating viscosity and a 4-hydroxybenzamide according to formula (I) as a friction modifier.

A steel alloy is an alloy in which steel is alloyed with one or more elements in total amounts between 1.0% and 50% by weight, typically to improve its mechanical properties. Accordingly, the exemplary steel surface or steel alloy surface contains at least 50 wt. % iron. Exemplary elements used in forming steel alloys may be selected from manganese, nickel, chromium, molybdenum, vanadium, silicon, boron, aluminum, cobalt, copper, cerium, niobium, titanium, tungsten, tin, zinc, lead, zirconium, and combinations thereof.

Diamond-like carbon surfaces may be formed, for example, according to the methods disclosed in U.S. Pub. No. 20110028361, and references cited therein, the disclosures of which are incorporated herein by reference in their entireties.

The method and exemplary lubricant composition may be suitable for refrigeration lubricants, greases, gear oils, axle oils, drive shaft oils, traction oils, manual transmission oils, automatic transmission oils, metal working fluids, hydraulic oils, and internal combustion engine oils. It finds particular application as a vehicle engine oil, such as crankcase oil. The exemplary lubricant composition may be supplied to a mechanical device, such as an engine of an automobile, and used for lubrication during normal operation of the mechanical device. In other embodiments, the lubricant composition finds use in vehicle driveline systems, such as transmission systems, particularly as a Synchromesh Transmission Fluid (SSTF).

In several embodiments a suitable lubricant composition includes the components present (on an actives basis) in ranges as shown Table I.

TABLE 1

| | Embodiments (wt. % of lubricant composition) | | |
|---|---|---|---|
| | A | B | C |
| Friction modifier | 0.01-2 | 0.1-1 | 0.3-0.6 |
| Other Performance Additives | 0-20 | 0.5-20 | 4-15 |
| Oil of Lubricating Viscosity | 30-99 | 40-98 | 60-95 |
| Total of components | 100 | 100 | 100 |

An engine oil fluid prepared with N-oleyl-4-hydroxybenzamide was compared with an engine oil fluid containing glycerol mono-oleate (GMO) as a friction modifier, but which was otherwise identical. The exemplary N-oleyl-4-hydroxybenzamide was found to reduce friction and to maintain wear performance comparable to the composition containing GMO at equal treat rates.

The following examples provide an illustration of the invention. These examples are non-exhaustive and are not intended to limit the scope of the invention.

Example 1 (EX1): Formation of N-oleyl-4-hydroxybenzamide 0.75 moles (114 g) of 4-hydroxybenzoic acid methyl ester and 0.75 moles (200.25 g) of oleylamine were charged into a 500 ml flange flask fitted with a lid, PTFE gland, overhead stirrer, thermocouple, nitrogen inlet, Dean-Stark trap, and condenser. The reaction mixture was stirred and heated to 80° C., and the temperature raised at intervals over a period of 23 hours, to 180° C. which was maintained for 48 hrs. The reaction mixture was cooled to provide a yellow gel (226.66 g). TAN was estimated at less than 4.

Comparative Example 2 (CEX2): Formation of N-oleyl-2-hydroxybenzamide (N-oleyl-salicylamide)

0.60 moles (91.2 g) of salicylic acid methyl ester and 0.60 moles (200.25 g) of oleylamine were charged into a 500 ml flange flask fitted with a lid, PTFE gland, overhead stirrer, thermocouple, nitrogen inlet, Dean-Stark trap, and condenser. The reaction mixture was stirred and heated to 90° C., and the temperature raised at intervals over a period of 30 hours, to 150° C. which was maintained for 24 hrs. The reaction mixture was cooled to provide a clear amber liquid (197 g).

Example 3: Preparation of Lubricant Compositions

Lubricant compositions are formulated by combining the products of Examples 1 and 2 with other lubricant components (base oil, viscosity modifier and pour point depressant) expressed by weight, in parts per hundred of the base oil, as follows. First, additive packages are prepared as shown in TABLE 2. All amounts are in wt. %. The additive package with the oleyl-4-hydroxybenzamide friction modifier is Example A. As a comparison, formulations are prepared without the friction modifier (Example B), with GMO (Example C), and with oleyl salicylamide (Example D).

As the oil of lubricating viscosity, a polyalphaolefin having a viscosity at 100° C. of 4 cSt is used (Nexbase 2004).

TABLE 2

Lubricant Compositions

| | Weight percent[1] | | | |
|---|---|---|---|---|
| Component | Example A | Comparative Example B | Comparative Example C | Comparative Example D |
| Group II Base Oil | Balance to 100% | Balance to 100% | Balance to 100% | Balance to 100% |
| OCP VI Improver[2] | 0.72 | 0.72 | 0.72 | 0.72 |
| Pourpoint depressant | 0.3 | 0.3 | 0.3 | 0.3 |
| PIB- | 2.7 | 2.7 | 2.7 | 2.7 |

TABLE 2-continued

| Lubricant Compositions | | | | |
|---|---|---|---|---|
| | Weight percent[1] | | | |
| Component | Example A | Comparative Example B | Comparative Example C | Comparative Example D |
| succinimide Dispersant | | | | |
| Secondary ZDDP | 0.78 | 0.78 | 0.78 | 0.78 |
| Ashless Antioxidant[3] | 1.8 | 1.8 | 1.8 | 1.8 |
| Overbased Ca sulfonate | 0.51 | 0.51 | 0.51 | 0.51 |
| Other Additives[4] | 0.8 | 0.8 | 0.8 | 0.8 |
| EX1 | 0.5 | 0 | 0 | 0 |
| GMO | 0 | 0 | 0.5 | 0 |
| CEX2 | 0 | 0 | 0 | 0.5 |

[1]Weight percent is based on oil-free active levels in lubricant composition
[2]OCP VI improver - Ethylene-propylene copolymer
[3]Ashless antioxidant is a combination of phenolic and diarylamine types
[4]Includes foam-inhibitors, sulfurized olefins and additional diluent oil The lubricant compositions were assessed for their frictional and wear performance using a high frequency reciprocating rig (HFRR) equipped with a standard steel ball on steel disk. The following test conditions were utilized: 200 N force, frequency of 20 Hz, 75 minutes duration, and temperature was held at 40° C. for 15 minutes and then ramped at 2° C. per minute to a final temperature of 160° C. (60 minute ramp).

Wear is assessed by measuring the width of the wear scar in the direction of reciprocation and at a right angle to it and calculating the average of these values.

Coefficient of friction (COF) is measured virtually continuously during the entire test. The average coefficient of friction is determined by averaging all of the measurements during the temperature ramp phase of the procedure. The test procedure has two phases, an initial isothermal stage followed by a ramp phase; the measured value is the average coefficient of friction during the temperature ramp phase only. The coefficient of friction is the frictional force measured parallel to the reciprocation divided by the applied force.

The lubricant compositions were also evaluated for friction reducing properties where at least one of the surfaces was coated with a Diamond-like Carbon coating (DLC). The test conditions and duration were the same as for the steel-on-steel testing above; however the test involved reciprocating a steel ball on a DLC coated surface.

Results for the steel-on-steel and steel-on-DLC tests are shown in TABLE 3 along with key elemental analyses (e.g., weight percent phosphorus).

TABLE 3

| Test Results for Lubricant Compositions | | | | |
|---|---|---|---|---|
| | Example A | Comp Example B | Comp Example C | Comp Example D |
| Ca (ppm) | 2000 | 2030 | 2010 | 2080 |
| Na (ppm) | 19 | 25 | 23 | 10 |
| P (ppm) | 740 | 750 | 750 | 750 |
| S (ppm) | 2790 | 2770 | 2770 | 2700 |
| Zn (ppm) | 790 | 790 | 800 | 830 |
| Sulfated Ash (wt %) | 0.83 | 0.83 | 0.83 | 0.83 |
| KV @100° C. (cSt) | 10.6 | 10.8 | 10.4 | |
| HFRR Steel-on-Steel | | | | |
| Wear scar (μm) | 115 | 121 | 116 | 121 |
| Ave. COF | 0.112 | 0.146 | 0.107 | 0.128 |
| HFRR Steel-on-DLC | | | | |
| Wear scar (μm) | 110 | 115 | 129 | 137 |
| Ave. COF | 0.117 | 0.128 | 0.100 | 0.122 |

The lubricant containing 4-hydroxybenzamide (EX A) showed comparable frictional and anti-wear performance to the lubricant with GMO (EX C) in the steel-on-steel test. However, when the test surface included a DLC coating, the 4-hydroxybenzamide was significantly better at reducing wear while maintaining frictional performance. In contrast, the lubricant containing the ortho-hydroxybenzamide (EX D) was inferior at reducing friction and wear in both the steel-on-steel test and the steel-on-DLC test.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements. As used herein, the expression "consisting essentially of" permits the inclusion of substances that do not materially affect the basic and novel characteristics of the composition under consideration. As used herein any member of a genus (or list) may be excluded from the claims.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

a. hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

b. substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

c. hetero substituents, that is, substituents which, while having a predominantly hydrocarbon character, in the context of this invention, contain other than carbon in a ring or chain otherwise composed of carbon atoms; and d. heteroatoms include sulfur, oxygen, nitrogen, and encompass substituents as pyridyl, furyl, thienyl and imidazolyl. In general, no more than two, in one aspect no more than one, non-hydrocarbon substituent will be present for every ten carbon atoms in the hydrocarbyl group; typically, there will be no non-hydrocarbon substituents in the hydrocarbyl group.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A lubricant composition comprising:

an oil of lubricating viscosity, and a 4-hydroxybenzamide as a friction modifier;

wherein the lubricant composition has a kinematic viscosity at 100° C. of from 5 to 18 $mm^2/s$.

2. The lubricant composition of claim 1, wherein the 4-hydroxybenzamide has the general formula:

(I)

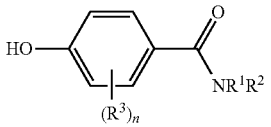

where $R^1$ and $R^2$ are independently selected from hydrogen and a hydrocarbyl group containing from 1 to 32 carbon atoms, and at least one of $R^1$ and $R^2$ is a hydrocarbyl group or wherein the $R^1$ and $R^2$ groups together form a ring;

each $R^3$ is independently selected from hydrogen and a hydrocarbyl group of 1 to 8 carbon atoms; and n is an integer from 0 to 3.

3. The lubricant composition of claim 2, wherein $R^1$ is hydrogen, n is 0, and $R^2$ is a hydrocarbyl group of 18 carbon atoms.

4. The lubricant composition of claim 2, wherein at least one of $R^1$ and $R^2$ is a hydrocarbyl group containing from 8 to 32 carbon atoms.

5. The lubricant composition of claim 2, wherein at least one of $R^1$ and $R^2$ is a hydrocarbyl group containing from 16 to 20 carbon atoms.

6. The lubricant composition of claim 2, wherein the 4-hydroxybenzamide includes at least one of an alkyl-4-hydroxybenzamide and an alkenyl-4-hydroxybenzamide.

7. The lubricant composition of claim 5, wherein the 4-hydroxybenzamide comprises N-oleyl-4-hydroxybenzamide.

8. The lubricant composition of claim 1, wherein the 4-hydroxybenzamide is present in the lubricant composition at a concentration of up to 5 wt. %.

9. The lubricant composition of claim 1, wherein the 4-hydroxybenzamide is present in the lubricant composition at a concentration of up to 1 wt. %.

10. The lubricant composition of claim 1, wherein the 4-hydroxybenzamide is present in the lubricant composition at a concentration of at least at least 0.05 wt. %.

11. The lubricant composition of claim 1, wherein the 4-hydroxybenzamide is present in the lubricant composition at a concentration of at least 0.05 wt. %.

12. The lubricant composition of claim 1, wherein the oil of lubricating viscosity is present in the lubricant composition at a concentration of at least 40 wt. %.

13. The lubricant composition of claim 1, wherein the oil of lubricating viscosity has a kinematic viscosity at 100° C. of from 3 to 10 $mm^2/s$.

14. The lubricant composition of claim 1, wherein sulphated ash is present in the lubricant composition at 0.1 wt. % up to 1.3 wt. %.

15. The lubricant composition of claim 1, wherein the lubricating oil comprises a polyalphaolefin.

* * * * *